US005670929A

United States Patent [19]

Totsuka

[11] Patent Number: 5,670,929

[45] Date of Patent: Sep. 23, 1997

[54] FUSIBLE LINK

[75] Inventor: Mitsuhiko Totsuka, Shizuoka, Japan

[73] Assignee: Yazaki Corporation, Tokyo, Japan

[21] Appl. No.: 734,023

[22] Filed: Oct. 18, 1996

[30] Foreign Application Priority Data

Oct. 19, 1995 [JP] Japan ..... 7-271320

[51] Int. Cl.[6] ..... H01H 85/02; H01H 85/36; H01H 85/52; H01R 13/68

[52] U.S. Cl. ..... 337/201; 337/190; 337/216; 439/622

[58] Field of Search ..... 337/201, 190, 337/216, 186, 187, 194, 198; 439/621, 622

[56] References Cited

U.S. PATENT DOCUMENTS

| | | | |
|---|---|---|---|
| 4,801,275 | 1/1989 | Ikeda | 439/350 |
| 5,294,906 | 3/1994 | Totsuka | 337/260 |
| 5,398,015 | 3/1995 | Kudo | 337/255 |
| 5,416,461 | 5/1995 | Totsuka et al. | 337/261 |
| 5,488,345 | 1/1996 | Seki | 337/186 |
| 5,528,213 | 6/1996 | Kondo | 337/160 |

FOREIGN PATENT DOCUMENTS 6-176681 6/1994 Japan .

*Primary Examiner*—Leo P. Picard
*Assistant Examiner*—Stephen T. Ryan
*Attorney, Agent, or Firm*—Sughrue, Mion, Zinn, Macpeak, and Seas.

[57] ABSTRACT

A fusible link in which the overlooking of a half-fitted condition of a spacer is positively prevented, and the strength of retaining of the spacer on a housing is increased. Guide walls are formed on an inner surface of the housing (which houses a fuse element), and are disposed respectively in the vicinity of projections for retaining the fuse element-holding spacer. Each of the guide walls forms an insertion space into which a respective one of resilient engagement piece portions of the spacer can be inserted, and the insertion space provides a space which allows elastic displacement of the resilient engagement piece portion when the resilient engagement piece portion is brought into and out of engagement with the projection. Tongue-like portions extend downwardly from a lid which closes an upper open end of the housing, and each of the tongue-like portions is inserted into that portion of the associated insertion space provided between the associated guide wall and the associated resilient engagement piece portion, thereby limiting elastic displacement of the resilient engagement piece portion retainingly engaged with the projection.

5 Claims, 3 Drawing Sheets

FUSIBLE LINK

BACKGROUND OF THE INVENTION

1. Field of the Invention

This invention relates to a fusible link, and more particularly to a cartridge-type fusible link in which a fuse element, inserted into a housing of an insulative resin through a lower open end in the housing, is fixed by a spacer attached to a lower end portion of the housing.

1. Background

FIGS. 5 and 6 show a conventional fusible link of the cartridge type, and FIG. 5 is an exploded, perspective view of the conventional fusible link 1, and FIG. 6 is a cross-sectional view of an important portion of this fusible link 1.

The fusible link 1 includes a fuse element 6 of an integral construction which is formed or shaped by pressing a metal sheet, and includes a fusible portion 3, which is curved into a generally inverted U-shape, and has a melting portion 2 formed at its top or apex portion, and a pair of connection terminal portions 4 which extend respectively from opposite ends of the fusible portion 3, and are adapted to be screw-fastened and electrically connected to respective circuit members such as a bus bar, a housing 8 of an insulative resin which is of a generally hollow shape having upper and lower open ends, and surrounds the fusible portion 3 inserted into the housing 8 through the lower open end thereof, a lid 13 of an insulative resin which includes a lid plate portion 10 for closing the upper open end 9 of the housing 8, and fixing members 11 for fixing the lid 13 to the housing 8, and a spacer 19 of an integral construction which is made of an insulative resin, and includes a bottom plate portion 15 for closing the lower open end of the housing 8, and resilient engagement piece portions 17, which are formed upright on the bottom plate portion 15, and are engaged respectively with projections 16 (see FIG. 6) formed on an inner surface of the housing 8 at the lower end portion thereof, the spacer 19 being attached to the lower end portion of the housing 8, receiving the fusible portion 3 therein, to prevent the fuse element 6 from being disengaged from the housing 8 and also to close the lower open end of the housing 8.

In the fuse element 6, a pair of pawls 20 for positioning the fusible portion 3 within the housing 8 are formed respectively at the opposite sides of each of the lower (opposite) ends of the fusible portion 3 (that is, in the vicinity of the boundary between the fusible portion 3 and the connection terminal portion 4), and when the fusible portion 3 is inserted into the housing 8, these pawls 20 are engaged in respective grooves (not shown) formed in the housing 8, thereby positioning the fusible portion 3 within the housing 8 in the direction of insertion depth thereof and also in the direction of the width thereof.

As shown in FIGS. 5 and 6, the resilient engagement piece portion 17 of the spacer 19 has an engagement hole 22 in which the projection 16 can be received, and when each projection 16 is engaged in the associated resilient engagement piece portion 17 as shown in FIG. 6, element holder surfaces 23, formed on the bottom plate portion 15, are held respectively against the lower ends of the pawls 20, thereby preventing the fuse element 6 from being disengaged from the housing 8.

The lid 13 serves to prevent dust and the like from intruding into the housing 8 through the upper open end 9, thus protecting the fuse element 6, and the lid 13 also serves to prevent fragments of the melted portion from dissipating to the exterior of the housing 8 during the melting of the fuse element 6. A transparent window 25 is provided at a central portion of the lid plate portion 10 of the lid 13, and whether or not the melting portion 2 of the fusible portion 3, received in the housing 8, is melted and severed is confirmed with the eyes through this transparent window 25.

In this fusible link of the cartridge type, the fuse element, when melted, can be easily replaced by a new one, and besides since a contact resistance of a connected portion is suitably reduced, this fusible link has been now been used as a large-current fuse in various fields including an electric system of a vehicle.

In the above fusible link 1, when the spacer 19 is in a half-fitted condition (that is, the projection 16 on the housing 18 is half fitted in the resilient engagement piece portion 17 of the spacer 19), this can not be easily detected from the appearance and others. Therefore, there has been a possibility that the half-fitting of the spacer 19 is overlooked, so that the fuse element 6 is disengaged from the housing 8 at a later stage.

And besides, a fine deflection or a fine dimensional error due to a molding strain and the like remains in the resilient engagement piece portion 17 of the spacer 19 molded of a resin, and there is a possibility that the elastic force is lower than a design value set to maintain the engagement of the resilient engagement piece portion 17 with the project on 16 (see FIG. 6), and in such a case, when severe vibrations act on the fusible link used, for example, in an electric system of a vehicle, there has been a possibility that the resilient engagement piece portion 17 becomes disengaged from the projection 16.

SUMMARY OF THE INVENTION

With the above problems in view, it is an object of this invention to provide a fusible link of the type in which a half-fitted condition of a spacer will not be overlooked, and the strength of retaining of the spacer on a housing is increased so that the spacer will not be disengaged from the housing even if external vibrations and the like act on the fusible link, and the reliability of the fusible link is enhanced without increasing the number of the component parts.

The above object of the invention has been achieved by a fusible link including a fuse element of an integral construction which is formed by pressing a metal sheet, and includes a fusible portion, which is curved into a generally inverted U-shape, and has a melting portion formed at its top portion, and a pair of connection terminal portions which extend respectively from opposite ends of the fusible portion, and are adapted to be electrically connected to a circuit; a housing of an insulative resin which is of a generally hollow shape having upper and lower open ends, and surrounds the fusible portion inserted into the housing through the lower open end of the housing; a lid of an insulative resin which includes a lid plate portion for closing the upper open end of the housing, and fixing member for fixing the lid to the housing; and a spacer of an integral construction which includes a bottom plate portion for closing the lower open end of the housing, and resilient engagement piece portions, which are formed generally upright on the bottom plate portion, and are engaged with an inner surface of the housing, the spacer being attached to the lower end portion of the housing to retain the fuse element. The invention features that guide walls are formed on the inner surface of the housing, and each of the guide walls forms an insertion space into which a respective one of the resilient engagement piece portions can be inserted, and the insertion space provides a space which allows elastic displacement of the resilient engagement piece portion in a direction of a thickness thereof when the resilient engagement piece portion is brought into and out of engagement with the housing; and further, tongue-like portions extend downwardly from the lid, and each of the tongue-like portions is inserted into that portion of the associated insertion space provided between the associated resilient engagement piece portion, engaged with the housing, and the associated guide wall, thereby limiting elastic displacement of the resilient engagement piece portion.

In this fusible link, the fusible portion of the fuse element is first inserted into the housing through the lower open end of this housing, and in this condition in which the fusible portion is received in the housing, the spacer is attached to the lower end portion of the housing. Then, the lid is attached to the upper end of the housing to close the upper open end of the housing.

With this assembling procedure, before the lid is attached to the housing, a half-fitted condition of the spacer can be easily confirmed with the eyes through the upper open end of the housing which is still kept in an open condition.

Even if such half-fitted condition of the spacer is overlooked at this stage, this can be detected at a later stage. More specifically, if the spacer is in a half-fitted condition, each tongue-like portion, formed on the lid, is brought into engagement with the associated resilient engagement piece portion, kept elastically deformed in an improper position, when attaching the lid to the housing, so that the lid can not be attached to the housing. Therefore, the half-fitted condition of the spacer can be detected.

On the other hand, when the lid is attached to the housing, with the spacer completely fitted in the housing, each tongue-like portion, formed on the lid, enters the insertion space provided between the associated resilient engagement piece portion of the spacer and the guide wall, thereby limiting the elastic displacement of the resilient engagement piece portion. Thus, the tongue-like portion contributes to the double retaining construction, and therefore the strength of retaining of the spacer on the housing is increased, and the disengagement of the spacer from the housing due to external vibrations and so on is prevented, and therefore there is achieved the fusible link of high reliability.

DETAILED DESCRIPTION OF THE PREFERRED EMBODIMENT

Figure 1:
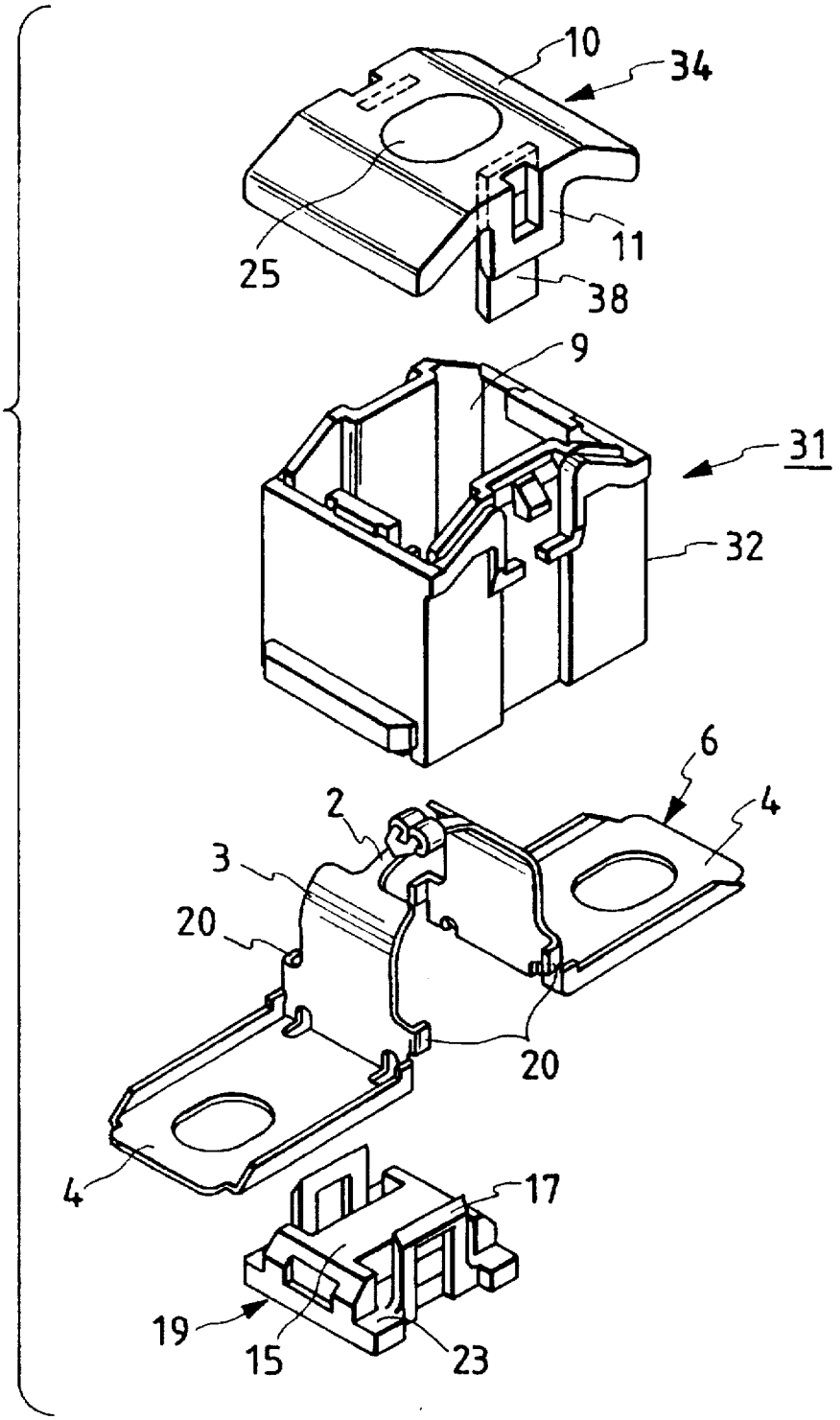
FIG. 1 is an exploded, perspective view of a preferred embodiment of a fusible link of the present invention.
Figure 2:
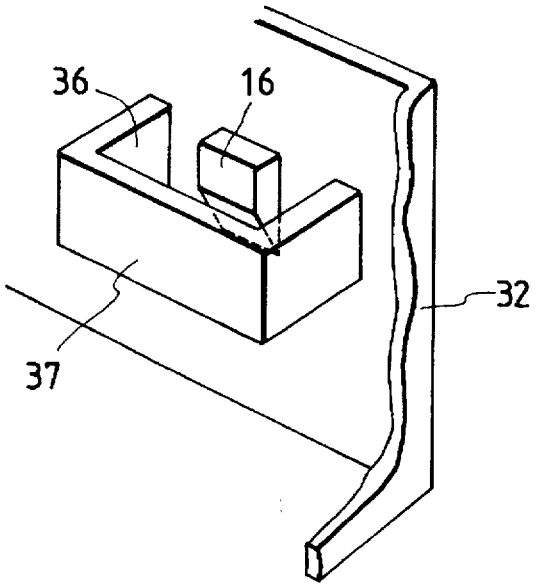
FIG. 2 is a cross-sectional view of an important portion of a housing used in the fusible link of FIG. 1.
Figure 3:
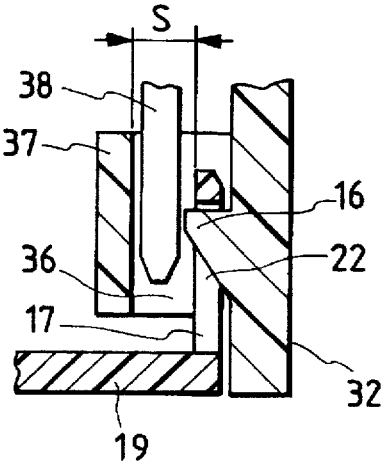
FIG. 3 is a cross-sectional view showing a condition of engagement of a spacer with the housing.
Figure 4:
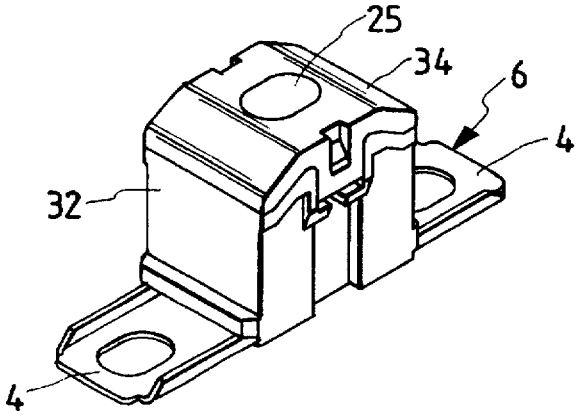
FIG. 4 is a perspective view of the fusible link in its assembled condition.

A preferred embodiment of a fusible link of the present invention will now be described in detail with reference to the drawings. FIG. 1 is an exploded, perspective view of the fusible link of the invention, FIG. 2 is a cross-sectional view of an important portion of a housing used in the fusible link of FIG. 1, FIG. 3 is a cross-sectional view showing a condition of engagement of a spacer with the housing, and FIG. 4 is a perspective view of the fusible link in its assembled condition.

The fusible link 31 includes a fuse element 6 of an integral construction which is formed or shaped by pressing a metal sheet, and includes a fusible portion 3, which is curved into a generally inverted U-shape, and has a melting portion 2 formed at its top or apex portion, and a pair of connection terminal portions 4 which extend respectively from opposite ends of the fusible portion 3, and are adapted to be screw-fastened and electrically connected to respective circuit members such as a bus bar, a housing 32 of an insulative resin which is of a generally hollow shape having upper and lower open ends, and surrounds the fusible portion 3 inserted into the housing 32 through the lower open end thereof, a lid 34 of an insulative resin which includes a lid plate portion 10 for closing the upper open end 9 of the housing 32, and fixing member 11 for fixing the lid to the housing 32, and a spacer 19 of an integral construction which is made of an insulative resin, and includes a bottom plate portion 15 for closing the lower open end of the housing 32, and resilient engagement piece portions 17, which are formed upright on the bottom plate portion 15, and are engaged respectively with projections 16 (see FIG. 3) formed on an inner surface of the housing 32 at the lower end portion thereof, the spacer 19 being attached to the lower end portion of the housing 32, receiving the fusible portion 3 therein, to prevent the fuse element 6 from being disengaged from the housing 32 and also to close the lower open end of the housing 32.

Figure 5:
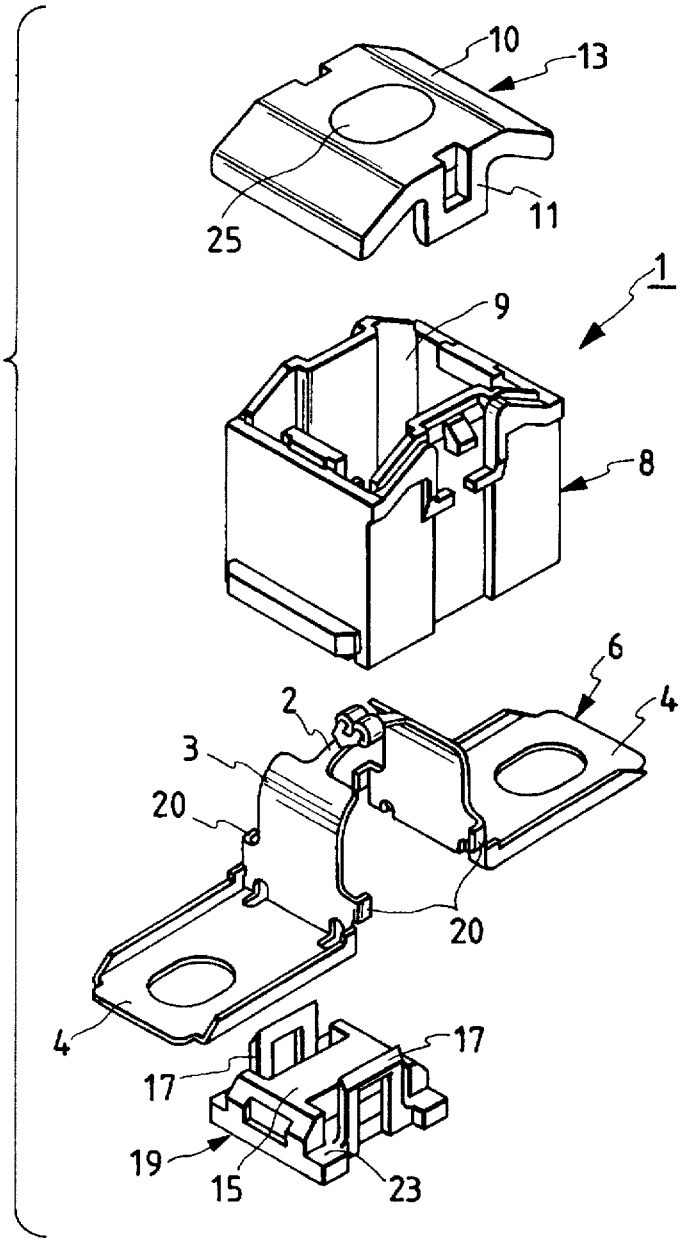
FIG. 5 PRIOR ART
FIG. 5 is an exploded, perspective view of a conventional fusible link.
Figure 6:
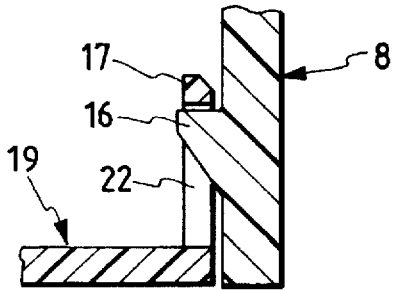
FIG. 6 PRIOR ART
FIG. 6 is a cross-sectional view of an important portion of the conventional fusible link of FIG. 5.

The fuse element 6 and the spacer 19 are substantially identical in construction respectively to the fuse element and the spacer of the conventional fusible link shown in FIG. 5.

Namely, in the fuse element 6, a pair of pawls 20 for positioning the fusible portion 3 within the housing 32 are formed respectively at the opposite sides of each of the lower (opposite) ends of the fusible portion 3 (that is, in the vicinity of the boundary between the fusible portion 3 and the connection terminal portion 4), and when the fusible portion 3 is inserted into the housing 32, these pawls 20 are engaged in respective grooves (not shown) formed in the housing 32, thereby positioning the fusible portion 3 within the housing 32 in the direction of insertion depth thereof and also in the direction of the width thereof.

As shown in FIGS. 1 and 3, the resilient engagement piece portion 17 of the spacer 19 has an engagement hole 22 in which the projection 16 can be retainingly received, and when each projection 16 is engaged in the associated resilient engagement piece portion 17 as shown in FIG. 3, element holder surfaces 23, formed on the bottom plate portion 15, are held respectively against the lower ends of the pawls 20, thereby preventing the fuse element 6 from being disengaged from the housing 32. Each projection 16 and the associated engagement hole 22 are relative portions with respect to each other, and there may be adopted an arrangement in which a projection is formed on the resilient engagement piece portion 17 while a recess, corresponding to the engagement hole 22, is formed in the inner surface of the housing 32.

As shown in FIGS. 2 and 3, a pair of guide walls 37 are formed on the inner surface of the housing 32, and are disposed respectively in the vicinity of the two projections 16 formed on the inner surface of the housing 32 at the lower end portion thereof. Each guide wall 37 forms an insertion space 36 into which the associated resilient engagement piece portion 17 can be inserted, and this insertion space 36 provides a space S which allows elastic deformation or displacement of the resilient engagement piece portion 17 in a direction of the thickness thereof when the resilient engagement piece portion 17 is brought into and out of engagement with the projection 16.

The lid 34 serves to prevent dust and the like from intruding into the housing 32 through the upper open end 9, thus protecting the fuse element 6, and the lid 34 also serves to prevent fragments of the melted portion from dissipating to the exterior of the housing 32 during the melting of the fuse element 6. A transparent window 25 is provided at a central portion of the lid plate portion 10, and whether or not the melting portion 2 of the fusible portion 3, received in the housing 32, is melted and severed is confirmed with the eyes through this transparent window 25. This construction is substantially the same as in the conventional construction.

However, the lid 34 of this embodiment is an improved one, and as shown in FIGS. 1 and 3, a pair of tongue-like portions 38 extend downwardly from the inner or lower surface of the lid plate portion 10. The tongue-like portion 38 is inserted into the space S between the resilient engagement piece portion 17, engaged with the projection 16 on the housing 32, and the guide wall 37, thereby limiting the elastic deformation or displacement of the resilient engagement piece portion 17.

In the fusible link 31 of the above construction, the fusible portion 3 of the fuse element 6 is first inserted into the housing 32 through the lower open end of this housing 32, and in this condition in which the fusible portion 3 is received in the housing 32, the spacer 19 is attached to the lower end portion of the housing 32, and then the lid 34 is attached to the upper end of the housing 32 to close the upper open end 9 of the housing 32.

With this assembling procedure, the condition of fitting of each projection 16 (which is formed on the inner surface of the housing 32 at the lower end portion thereof) in the associated resilient engagement piece portion 17 of the spacer 19 can be confirmed with the eyes through the upper open end 9 of the housing 32 to which the lid 34 has not yet attached and hence which is still kept in an open condition, and therefore if the spacer 19 is in a half-fitted condition, this can be confirmed with the eyes.

Even if such half-fitted condition is overlooked, that is, fails to be confirmed with the eyes, this can be detected at a later stage. More specifically, if the spacer 19 is in a half-fitted condition, each tongue-like portion 38, formed on the lid 34, is brought into engagement with the associated resilient engagement piece portion 17, kept elastically deformed in an improper position, when attaching the lid 34 to the housing 32, so that the lid 34 can not be attached to the housing 32. Therefore, the half-fitted condition of the spacer 19 is detected, and the overlooking of such half-fitted condition of the spacer 19 is positively prevented.

On the other hand, when the lid 34 is attached to the housing 32, with the spacer 19 completely fitted in the housing 32, each tongue-like portion 38, formed on the lid 34, enters the insertion space 36 having the space S formed between the associated resilient engagement piece portion 17 of the spacer 19 and the guide wall 37, thereby limiting the elastic displacement of the resilient engagement piece portion 17 in a direction out of engagement with the projection 16. Thus, the tongue-like portion 38 contributes to a double retaining construction, and therefore the strength of retaining of the spacer 19 on the housing 32 is increased, and the disengagement of the spacer 19 from the housing 32 due to external vibrations and so on is prevented, and therefore there is achieved the fusible link of high reliability.

The shape of the connection terminal portions 4 of the fuse element 6 and the specific construction of the guide walls 37 are not limited to those of this embodiment. Particularly, although the guide wall 37 is supported at its opposite ends on the housing in this embodiment, it may extend in a cantilever manner.

As described above, in the fusible link of the present invention, the fusible portion of the fuse element is first inserted into the housing through the lower open end of this housing, and in this condition in which the fusible portion is received in the housing, the spacer is attached to the lower end portion of the housing, and then the lid is attached to the upper end of the housing to close the upper open end of the housing.

With this assembling procedure, the condition of fitting of each projection (which is formed on the inner surface of the housing at the lower end portion thereof) in the associated resilient engagement piece portion of the spacer can be confirmed with the eyes through the upper open end of the housing 32 which is still kept in an open condition, and therefore if the spacer is in a half-fitted condition, this can be easily confirmed with the eyes.

Even if such half-fitted condition is overlooked, that is, fails to be confirmed with the eyes, this can be detected at a later stage. More specifically, if the spacer is in a half-fitted condition, each tongue-like portion, formed on the lid, is brought into engagement with the associated resilient engagement piece portion, kept elastically deformed in an improper position, when attaching the lid to the housing, so that the lid can not be attached to the housing. Therefore, the half-fitted condition of the spacer can be easily detected.

When the lid is attached to the housing, with the spacer completely fitted in the housing, each tongue-like portion, formed on the lid, enters the insertion space provided between the associated resilient engagement piece portion of the spacer and the guide wall, thereby limiting the elastic displacement of the resilient engagement piece portion 17 in a direction out of engagement with the projection 16. Thus, the tongue-like portion contributes to the double retaining construction, and therefore the strength of retaining of the spacer 19 on the housing 32 is increased, and the disengagement of the spacer from the housing 32 due to external vibrations and so on is prevented, and therefore there is achieved the fusible link of high reliability.

What is claimed is:

1. A fusible link, comprising:

a fuse element including a fusible portion having a melting portion formed at a top portion thereof, and a pair of connection terminal portions extending respectively from opposite ends of said fusible portion, said connection terminal portions adapted to be electrically connected to a circuit;

a housing having upper and lower openings, and surrounding said fusible portion inserted into said housing through said lower opening;

a lid including a lid plate portion for closing said upper opening of said housing, and fixing members for fixing said lid to said housing;

a spacer including a bottom plate portion for closing said lower opening of said housing, and resilient engagement piece portions formed on said bottom plate portion, and extended upwardly from said bottom plate portion, said resilient engagement piece portions being engaged with an inner surface of said housing, wherein said spacer is attached to a lower end portion of said housing to retain said fuse element;

guide walls formed on said inner surface of said housing, and each of said guide walls forming an insertion space into which a respective one of said resilient engagement piece portions is inserted, and said insertion space having a space which allows elastic displacement of said resilient engagement piece portion in a direction of a thickness thereof when said resilient engagement piece portion is brought into and out of engagement with said housing; and tongue-like portions extended downwardly from said lid, and each of said tongue-like portions inserted into a portion of the associated insertion space provided between the associated resilient engagement piece portion which is engaged with said housing, and the associated guide wall to limit the elastic displacement of said resilient engagement piece portion.

2. The fusible link of claim 1, wherein said fuse element is formed by pressing a metal sheet to an integral construction.

3. The fusible link of claim 1, wherein said fusible portion is curved into a substantially inverted U-shape.

4. The fusible link of claim 1, wherein said housing has a substantially hollow shape.

5. The fusible link of claim 1, wherein said spacer has engagement holes, and spacer-retaining projections are formed at a lower portion on said inner surface of said housing, and wherein when said spacer is attached to said housing, said spacer-retaining projections are engaged in said engagement holes, respectively.

* * * * *